US008635898B2

(12) United States Patent
Karino et al.

(10) Patent No.: US 8,635,898 B2
(45) Date of Patent: Jan. 28, 2014

(54) SPINNING METHOD FOR FORMING A DIAMETER REDUCED PORTION

(75) Inventors: Shinobu Karino, Osaka (JP); Akihiro Ando, Tokyo (JP); Jun Kurobe, Osaka (JP)

(73) Assignee: Nisshin Steel Co., Ltd., Tokyo (JP)

( * ) Notice: Subject to any disclaimer, the term of this patent is extended or adjusted under 35 U.S.C. 154(b) by 65 days.

(21) Appl. No.: 13/144,468

(22) PCT Filed: Jan. 5, 2010

(86) PCT No.: PCT/JP2010/050026

§ 371 (c)(1), (2), (4) Date: Oct. 21, 2011

(87) PCT Pub. No.: WO2010/084788

PCT Pub. Date: Jul. 29, 2010

(65) Prior Publication Data

US 2012/0024032 A1 Feb. 2, 2012

(30) Foreign Application Priority Data

Jan. 23, 2009 (JP) ..... 2009-013490

(51) Int. Cl.
*B21D 7/04* (2006.01)
*B21D 3/02* (2006.01)

(52) U.S. Cl.
USPC ..... 72/214; 72/84; 72/120; 72/121

(58) Field of Classification Search
USPC ..... 72/82–85, 107, 110, 370.01, 370.05, 72/370.24, 370.25, 96, 97, 208, 209, 214
See application file for complete search history.

(56) References Cited

U.S. PATENT DOCUMENTS

| | | | | |
|---|---|---|---|---|
| 4,566,300 | A * | 1/1986 | Gebelius | 72/63 |
| 6,386,010 | B1 * | 5/2002 | Irie et al. | 72/84 |
| 6,725,698 | B2 * | 4/2004 | Endo | 72/120 |
| 7,143,619 | B2 * | 12/2006 | Morikawa et al. | 72/84 |

FOREIGN PATENT DOCUMENTS

| | | |
|---|---|---|
| JP | S64-040117 A | 2/1989 |
| JP | 2000-263161 A | 9/2000 |
| JP | 2003-230917 A | 8/2003 |

OTHER PUBLICATIONS

International Search Report issued from the International Bureau of WIPO for International Application No. PCT/JP2010/050026 dated Feb. 2, 2010 (1 page) and an English translation of the same (1 page).

* cited by examiner

*Primary Examiner* — Dana Ross
*Assistant Examiner* — Mohammad Nourbakhsh
(74) *Attorney, Agent, or Firm* — Fitch, Even, Tabin & Flannery, LLP

(57) ABSTRACT

Provided is a spinning method of reducing a diameter of a work piece pipe body with processing rollers disposed on an outer surface of the work piece pipe body, the processing rollers being configured to be relatively revolved around the work piece pipe body, wherein, when the processing rollers are axially reciprocated while being moved in a radius direction of the work piece pipe body, wherein the diameter reducing process with the processing rollers is performed under a state in which a wound body formed of an elastic sheet-like material is inserted as a core body into the inside of a portion of the work piece pipe body to be subjected to the diameter reducing processing.

2 Claims, 4 Drawing Sheets

| | WITH CORE BODY | WITHOUT CORE BODY |
|---|---|---|
| 0.8t |  |  |
| 1.05t |  |  |

SPINNING METHOD FOR FORMING A DIAMETER REDUCED PORTION

CROSS-REFERENCE TO A RELATED APPLICATION

This application is a U.S. national phase application filed under 35 U.S.C. §371 of International Application PCT/JP2010/050026, filed on Jan. 5, 2010, designating the United States, which claims priority from JP 2009-013490, filed on Jan. 23, 2009, which are hereby incorporated herein by reference in their entirety.

FIELD OF THE INVENTION

The present invention relates to a method for forming a diameter reduced portion at, for example, a pipe end of a metal pipe body such as a steel pipe used for automobile converter cases or mufflers.

BACKGROUND OF THE INVENTION

For cases for exhaust-gas purifying catalysts (converters) or cases for mufflers, which are mounted to automobile exhaust systems of automobiles, pipes having a large diameter are used as raw material in order to increase capacity. Further, an end portion of the case member is provided with a tapered portion for connection to a forward or rearward member, and is optionally further, provided with a straight pipe portion having a smaller diameter that is continuous with the tapered portion.

FIG. 1 illustrates an example of such a case 1 including: a pipe portion (1*c*) having a large diameter as a raw material; tapered portions (1*b*) provided for connection to forward and rearward members; and straight pipe portions (1*a*) each having a smaller diameter and being continuous with the tapered portion.

As a processing method, the spinning method as illustrated in FIG. 2 has been used in many cases.

Further, for the purpose of suppressing wrinkles at the time of processing, adjusting the sheet thickness of the work piece, or improving dimensional accuracy of the inner and outer surfaces to be processed, for example, a method using a core body as illustrated in FIG. 3 has been also carried out.

However, when performing the processing with a large number of passes, the core body functions effectively only at the final pass, but barely functions in the midway process. Further, for reasons such as requiring a jig for holding the core body, the technology using the core body when performing diameter reducing processing on the pipe end is not necessarily practical.

Therefore, when performing spinning on the pipe end for reduction of the diameter thereof, processing has been often performed without using the core body while pressing rollers onto a pipe body in a hollow state.

In the case of performing the spinning without using a core body, in order to perform the processing without a problem, it is necessary to maintain the original shape of the pipe body against the processing force applied by the rollers.

However, for such an article obtained by processing the pipe body, there are demands for reduction in thickness of a pipe wall for the purpose of reducing weight, etc. When the pipe wall is reduced in thickness in comparison with the diameter of the pipe body, rigidity of the pipe body is insufficient. As a result, the shape accuracy of the article obtained by processing the pipe body is reduced. Further, when the work piece pipe body is elastically bent or corrugated during the spinning, the rollers collide against the deformed portion, and hence wrinkles or deformations occur in regions subjected to the spinning, with the result that it is impossible to continue spinning. In other words, a defective article as illustrated in FIG. 4 is formed.

Such a phenomenon where shape accuracy is reduced and the processing cannot be continued is more likely to occur as the thickness of the work piece pipe body becomes smaller or as processing speed becomes faster.

In this context, JP 2006-346695 A proposes the following. In order to suppress elastic deformation resulting from the insufficient rigidity of the work piece pipe body, prevent occurrence of wrinkles and cracks, and increase shape accuracy and processing speed, when performing the spinning for reducing a rotating metal pipe body without using a molding die while pressing the processing roller on the outer surface of the pipe body, a filler made of a foam resin is interposed inside the pipe body, and the pipe body is subjected to the diameter reducing processing by the processing roller together with the filler.

SUMMARY OF THE INVENTION

In the above-mentioned method proposed in Patent Literature 1, it is possible to attain some positive effect of being capable of suppressing elastic deformation resulting from the insufficient rigidity of the work piece pipe body preventing a failure of processing such as the occurrence of vibration, wrinkles, and cracks during the processing, and increasing shape accuracy and processing speed.

However, when pressure is applied, the foam resin filled inside the work piece pipe body is deformed because its internal air bubbles collapse. Therefore, the outward repulsive force of the foam resin is reduced, which is not enough to compensate the rigidity of the work piece pipe body. That is, the filled foam resin follows deformation of the work piece pipe body and functions relatively well when the deformation amount is small, but cannot be expected to exert a repulsive force equivalent to the deformation amount when the deformation amount is large.

Further, the foam resin filled inside the work piece pipe body is in such a filled form that its shape is deformed in conformity to the shape of the pipe end along with the diameter reducing processing performed on the pipe end. Accordingly, it is not easy to remove the foam resin from the opening of the pipe end, which causes deterioration of productivity. In addition, the foam resin used as the filler cannot be reused at all. Therefore, the technology of using the foam resin as proposed in Patent Literature 1 results in cost increases.

The present invention has been made in order to solve the above-mentioned problems, and it is an object of the present invention to provide a spinning method with good productivity, in which, when a diameter reduced portion is formed at, for example, the pipe end of a metal pipe body, elastic deformation resulting from insufficient rigidity of the work piece pipe body is suppressed, occurrence of wrinkles and cracks is prevented, and shape accuracy and processing speed are increased.

In order to achieve the object of the present invention, the present invention provides a spinning method of reducing a diameter of a work piece pipe body with processing rollers disposed on an outer surface of the work piece pipe body, the processing rollers being configured to be relatively revolved around the work piece pipe body, wherein, when the processing rollers are axially reciprocated while being moved in a radius direction of the work piece pipe body, wherein the diameter reducing process with the processing rollers is performed under a state in which a wound body formed of an elastic sheet-like material is inserted as a core body into the inside of a portion of the work piece pipe body to be subjected to the diameter reducing processing.

It is preferred that a wound body using a spring steel sheet as the elastic sheet-like material is used as a core body.

In the spinning method according to the present invention, using the processing rollers which are disposed on an outer surface of the work piece pipe body and are configured to be relatively revolved around the work piece pipe body, a wound body formed of the elastic sheet-like material such as spring steel sheet is inserted as the core body when performing the diameter reducing processing on the work piece pipe body by reciprocating the processing rollers in the axial direction while moving the processing rollers in the radial direction of the work piece pipe body. The wound body formed of spring steel sheet or the like serves as the core body having a variable diameter, and hence functions effectively as the core body at all stages when performing the diameter reducing processing with a large number of passes. In addition, even when the work piece pipe body is a material having a small thickness, it is possible to suppress elastic deformation resulting from insufficient rigidity of the work piece pipe body. Further, it is possible to prevent failure of processing such as occurrence of vibration, wrinkles, and cracks during the processing, and to increase shape accuracy and processing speed. Still further, not only it is easy to remove the core body after the processing, but it is also possible to reuse the wound body as a core body. Thus, it is possible to perform the spinning with good productivity.

DETAILED DESCRIPTION OF THE PREFERRED EMBODIMENTS

The inventors of the present invention studied the technical problems of Patent Literature 1 in which a foam resin is used as a core body when performing diameter reducing processing on a pipe end, and redoubled their investigation of a core body that can be reused and exert a strong outward repulsive force even when being reduced in diameter.

In this process, the inventors of the present invention found that a tubular wound body, which is formed of an elastic sheet-like material such as a spring steel sheet, can be used as the core body.

In the following, detailed description is made of a mode of using the wound body formed of spring steel sheet as the core body.

Figure 5:
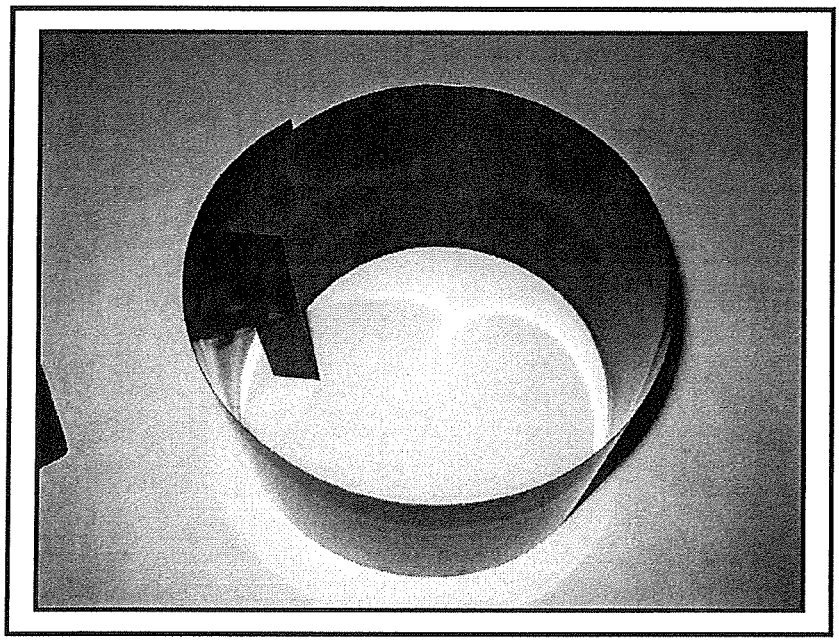
FIG. 5 is a view illustrating a wound body formed of a spring steel sheet, the wound body serving as a core body with a variable diameter and being used in the present invention.

The wound body formed of spring steel sheet, which is used as a core body in a spinning method according to the present invention, is a single-turn or several-turn tubular body that is obtained by winding a normal thin spring steel sheet as illustrated in FIG. 5. It is necessary that at least an end the inner sheet overlaps the inner wall of the outer sheet. As illustrated in FIG. 5, it is preferred that the end of the inner sheet is bent inward so as to easily slide along the inner wall of the outer sheet as the diameter of the wound body decreases.

As the wound body formed of the spring steel sheet has a larger number of turns, the repulsive force when the wound body is reduced in diameter increases. This is the same as a coil spring. The wound body is taken out against the repulsive force which has increased after termination of diameter reducing processing, and hence a wound body having a great number of turns is not required. A single-turn or double-turn wound body suffices, though this depends on the characteristics of the spring steel sheet.

It suffices that the tube length of the wound body slightly exceeds the length of a diameter reduced portion to be processed.

Next, detailed description is made of a method of performing spinning using the above-mentioned wound body formed of spring steel sheet.

Figure 6:
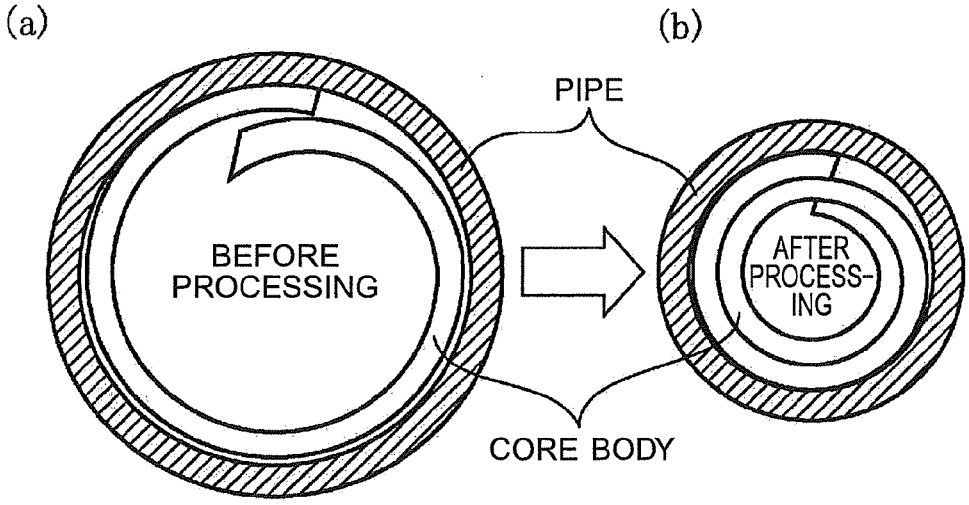
FIG. 6 is a schematic view illustrating the spinning method according to the present invention.

FIG. 6 is a schematic view illustrating a method of performing diameter reducing processing on a pipe end using the spinning method according to the present invention. First, as illustrated in part (a) of FIG. 6, the wound body formed of spring steel sheet is inserted into the pipe end to be processed. At this time, the wound body is inserted after being reduced in diameter by a force resisting its outward repulsive force. After the force resisting the repulsive force is relieved, the wound body formed of spring steel sheet is held inside a work piece pipe body in a state in which the wound body is increased in diameter so as to conform to the inner diameter of the work piece pipe body and presses the inner wall of the work piece pipe body outward from the inside of the work piece pipe body.

Figure 1:
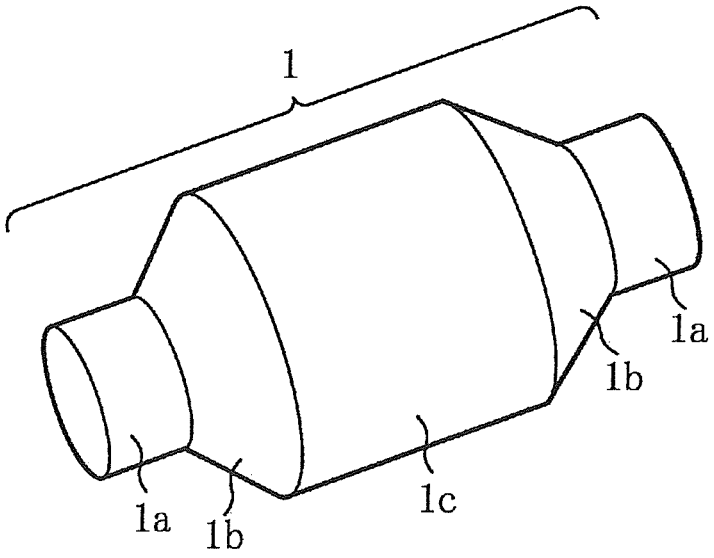
FIG. 1 is a schematic view illustrating a shape of a case for an exhaust-gas purifying catalyst (converter).
Figure 2:
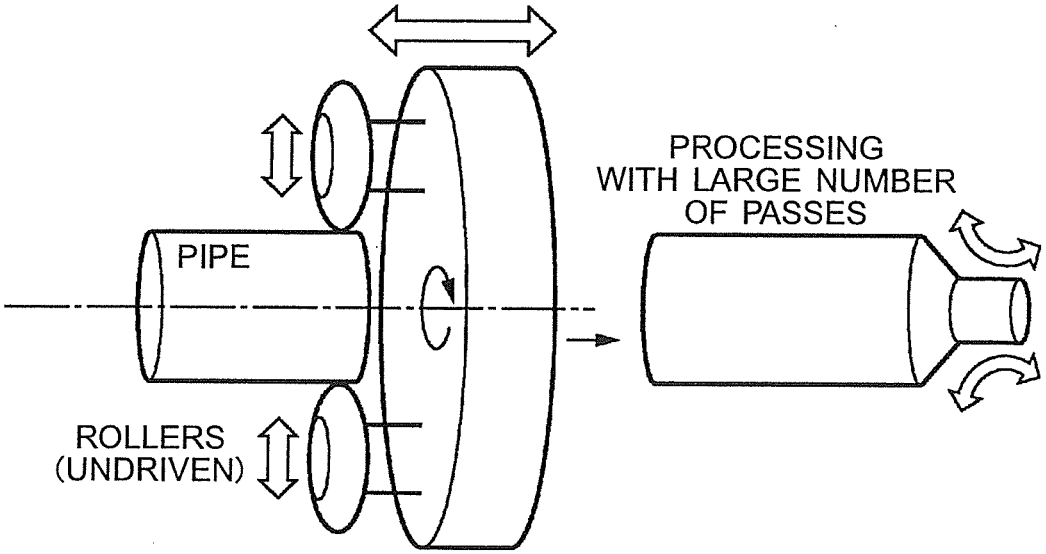
FIG. 2 is a schematic view illustrating a spinning method.
Figure 3:
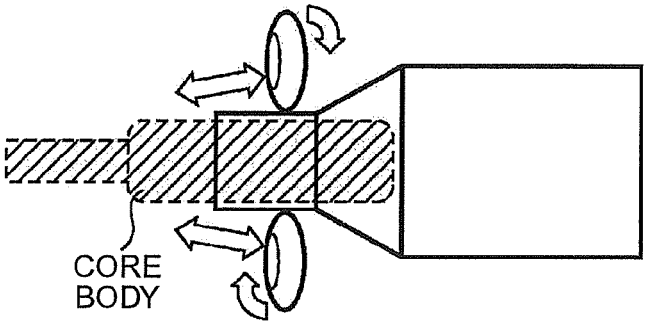
FIG. 3 is a view illustrating a spinning method using a core body.
Figure 4:
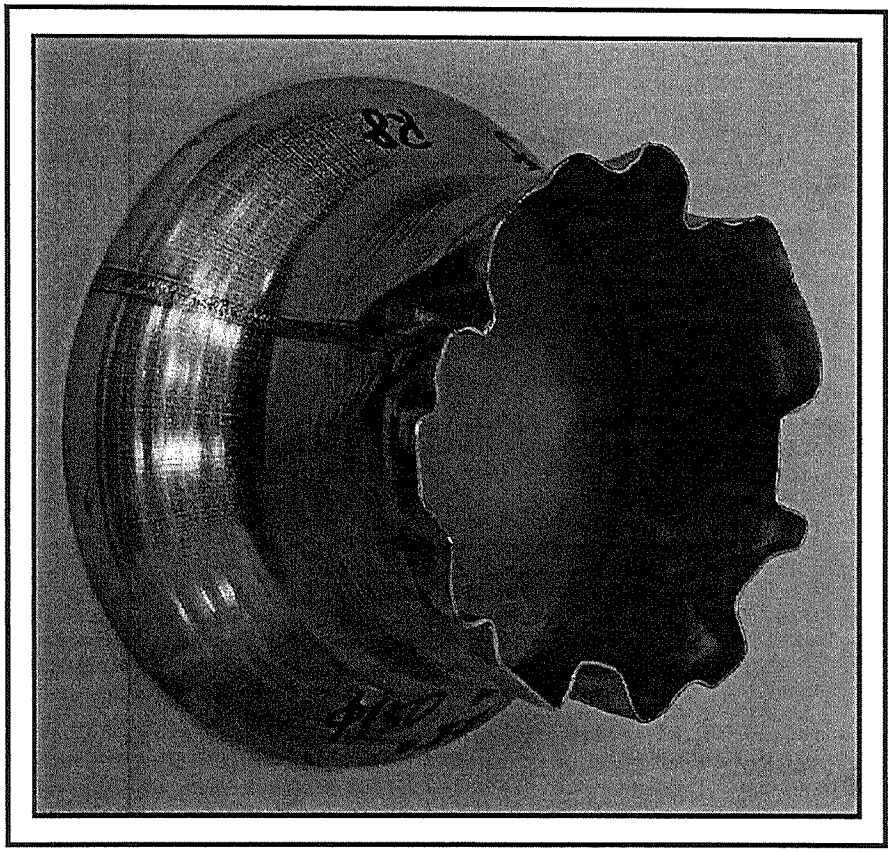
FIG. 4 is a view illustrating a defect that is likely to occur at the time of spinning.

In this state, in a similar way to that illustrated in FIGS. 2 and 3, the diameter reducing processing is performed on the pipe end by a processing roller (see a part (b) of FIG. 6). At this time, as described above, the wound body formed of the spring steel sheet is held in the state of being pressed to the inner wall of the pipe end by its repulsive force, and hence it is unnecessary to separately hold and support the wound body formed of the spring steel sheet. The diameter of the wound body is reduced along with the diameter reducing processing performed on the pipe end, and the repulsive force thereof increases along with the processing.

Note that, FIGS. 2 and 3 illustrate a mode of fixing the work piece pipe body and revolving the processing rollers when performing the spinning. However, a mode of rotating the work piece pipe body may also be adopted.

Although the outward pressing force of the core body including the wound body formed of spring steel sheet supplements the rigidity of the work piece pipe body, this pressing force increases along with progress of the diameter reducing processing. So, even when the thickness of the work piece pipe body is thin, it is possible to suppress elastic deformation resulting from insufficient rigidity of the work piece pipe body itself.

When performing the diameter reducing processing on the pipe end, cracks are likely to occur when the material is not restrained at the region to be processed. However, when the core body is inserted along the pipe end, in particular, when the core body is inserted along the pipe end while the pressing force is being applied to the pipe end as in the present invention, the effect of restraining the material at the region to be processed increases. As a result, it is possible not only to prevent the occurrence of cracks at the time of the processing, but also to increase shape accuracy and processing speed.

After termination of the processing, the wound body formed of spring steel sheet, which is used as the core body, is taken out.

Along with the processing, the diameter of the wound body formed of spring steel sheet is decreased, and the outward repulsive force is further increased. Therefore, in order to decrease the diameter of the wound body and remove the wound body from the work piece pipe body, it is necessary to apply a force larger than the increased repulsive force to the wound body. However, there is no difficulty in removal, outside of a force larger than the increased repulsive force being required.

The removed wound body formed of spring steel sheet returns to its original shape, and hence can be used as a core body again when performing a diameter reducing processing on a pipe body. Therefore, it is possible to reduce manufacturing cost.

Normally, in spinning performed on pipe ends, the diameter reducing processing is often performed on the pipe end portion while maintaining its complete round shape (true circle shape). The method according to the present invention is adopted to the normal diameter reducing processing of a complete-round portion as described above, but may also be applicable to the diameter reducing processing of a diameter reduced portion which is formed at a pipe end into not a complete round shape but into an elliptical shape having slightly different lengths of major and minor axes.

That is, the wound body formed of thin spring steel sheet is deformed along the shape of the inner wall of the pipe body to be molded, and hence is deformed along the shape of the pipe end to be processed as long as the pipe end does not have a rectangular cross-section. Accordingly, without any problem, the present invention is also applicable to the diameter reducing processing into an elliptical shape having different lengths of major and minor axes.

Note that, description is made above of the mode of performing the diameter reducing processing on the pipe end of the work piece pipe body. However, it is needless to say that the present invention is also applicable to regions other than pipe ends (for example, center portions in a longitudinal direction of the work piece pipe body).

EXAMPLE

As a sample, an electric-resistance-welded tube was used having an outer diameter of 150 mm, and formed of ferritic stainless steel. In this case, as raw materials, three kinds of steel pipes were used having a sheet thickness of 0.8 mm, 1.05 mm, and 1.2 mm.

As a core body, a single-turn wound body was used having a diameter of 150 mm and a width of 100 mm, which was formed of cold-rolled steel sheet for springs (JISG4802, S55C-CSPB) having a sheet thickness of 0.5 mm.

The wound body formed of this spring steel sheet was inserted into a pipe end of each of the three kinds of steel pipes mentioned above to be processed, and processing rollers were brought into contact with the steel pipe to be processed while being rotated at 600 rpm. Then, diameter reducing processing was performed under a condition that feed speed was 6000 mm/min, the number of passes was 11, and the diameter reduction ratio was 60% until the outer diameter of the pipe end was reduced to 90 mm.

Figure 7:
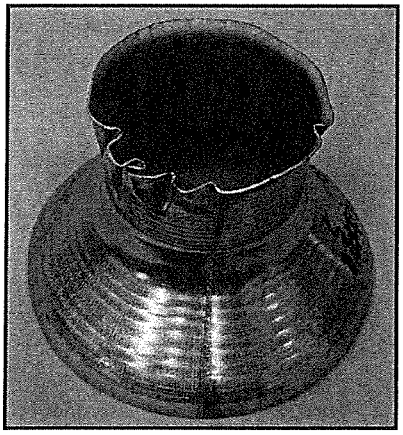
FIG. 7 is a summary view of results of Examples.
Figure 7:
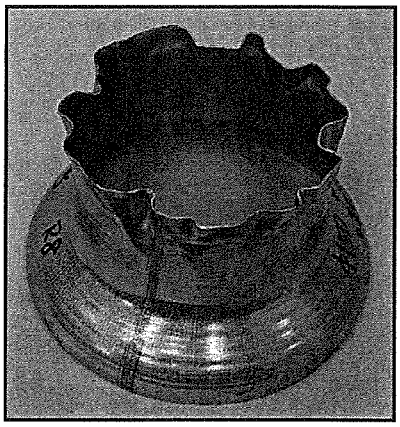
Figure 7:
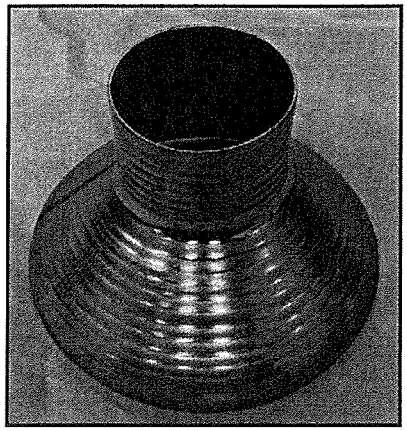
Figure 7:
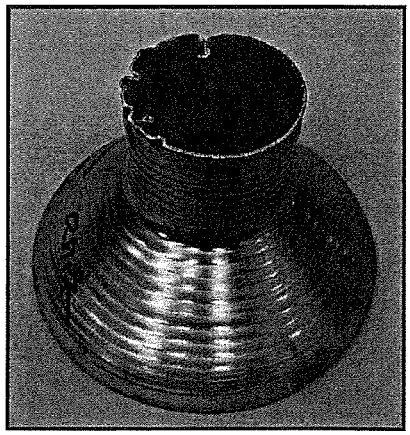

In a case where the sheet thickness of the steel pipe as a raw material was 0.8 mm, regardless of whether or not the core body was used, wrinkles occurred before the steel pipe was reduced in diameter to the diameter reduction ratio of 60%, and hence it was impossible to continue the processing. However, as illustrated in FIG. 7, wrinkles occurred at an early stage of the processing in a case where the core body was not used, whereas wrinkles occurred at a later stage of the processing in a case where the core body was used.

Further, in a case where the sheet thickness of the steel pipe as a raw material was 1.2 mm, regardless of whether or not the core body was used, it was possible to perform the diameter reducing processing under a condition that the diameter reduction ratio was up to 60%.

Meanwhile, in a case where the sheet thickness of the steel pipe as a raw material was 1.05 mm, when the wound body formed of spring steel sheet was used as the core body according to the present invention, it was possible to perform the diameter reducing processing under a condition that the diameter reduction ratio was up to 60%. However, when the wound body formed of spring steel sheet was not used, it was impossible to perform the diameter reducing processing under a condition that the diameter reduction ratio was 60% (see FIG. 7).

A summary of the results is shown in Table 1. It is possible to understand the usefulness of the wound body formed of spring steel sheet, which is used as the core body.

Further, it is needless to say that, as long as the wound body can suppress elastic deformation resulting from the insufficient rigidity of the work piece pipe body to be processed at the time of the spinning, a wound body formed of a material other than spring steel sheet is also applicable as a wound body formed of an elastic sheet-like material, which is used as the core body.

TABLE 1

| Results of tests | | |
|---|---|---|
| Sheet thickness of pipe (mm) | With core body | Without core body |
| 0.8 t | x | x |
| 1.05 t | ○ | x |
| 1.2 t | ○ | ○ |

The invention claimed is:

1. A spinning method for reducing a diameter of a pipe body, the spinning method comprising:

winding a sheet of elastic material into a tubular wound body for fitting in an interior of the pipe body;

inserting the tubular wound body into the pipe body interior with the elasticity thereof causing the tubular wound body to press against an interior surface of the pipe body to exert a generally radially outwardly directed force thereagainst;

revolving processing rollers and the pipe body relative to each other with the processing rollers engaging an outer surface of the pipe body; and reciprocating the processing rollers axially along the pipe body and shifting the processing rollers in a radially inward direction with the tubular wound body exerting the generally radially outwardly directed force against the pipe body interior surface during the relative revolving of the processing rollers and the pipe body and during the axial reciprocation and radially inward directed shifting of the processing rollers.

2. A spinning method according to claim 1, wherein the sheet of elastic material of the tubular wound body is a spring steel sheet.

* * * * *